US012344973B2

(12) United States Patent
Cong et al.

(10) Patent No.: US 12,344,973 B2
(45) Date of Patent: Jul. 1, 2025

(54) FULLY AUTOMATIC METHOD FOR HANDLING YARN KNOTS IN A CONTINUOUS FLAT KNITTING PROCESS

(71) Applicant: JIANGNAN UNIVERSITY, Wuxi (CN)

(72) Inventors: Honglian Cong, Wuxi (CN); Gaoming Jiang, Wuxi (CN); Zhijia Dong, Wuxi (CN); Chaoyu Chen, Wuxi (CN); Yuxian Li, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 0 days.

(21) Appl. No.: 18/629,220

(22) Filed: Apr. 8, 2024

(65) Prior Publication Data

US 2024/0254665 A1 Aug. 1, 2024

Related U.S. Application Data

(63) Continuation of application No. PCT/CN2022/132731, filed on Nov. 18, 2022.

(30) Foreign Application Priority Data

Nov. 22, 2021 (CN) ..... 202111386481.0

(51) Int. Cl.
*D04B 15/70* (2006.01)
*D04B 15/56* (2006.01)
*D04B 35/20* (2006.01)

(52) U.S. Cl.
CPC ..... *D04B 15/70* (2013.01); *D04B 15/565* (2013.01); *D04B 35/20* (2013.01)

(58) Field of Classification Search
USPC ..... 700/141
See application file for complete search history.

(56) References Cited

U.S. PATENT DOCUMENTS 4,331,008 A * 5/1982 Kurner ..... B65H 63/028 28/222
4,531,385 A * 7/1985 Jacobsson ..... D04B 15/482 66/132 T (Continued)

FOREIGN PATENT DOCUMENTS

CN 101313097 A 11/2008
CN 107829203 A * 3/2018 ..... D04B 15/38

(Continued)

OTHER PUBLICATIONS

International Search Report and Written Opinion issued in International Application No. PCT/CN2022/132731; mailed Feb. 13, 2023; 15 pgs.

(Continued)

*Primary Examiner* — Aiying Zhao
(74) *Attorney, Agent, or Firm* — HAUPTMAN HAM, LLP

(57) ABSTRACT

The method includes the following steps: A knot alarm detects knots and triggers an alarm; the machine automatically loads and runs a preset knot handling program; the machine pulls out the yarn segment containing the knot from the knitting area and secures the knot; the machine reinserts the subsequent yarn back into the knitting area, returning to the knitting position before the alarm; the machine cuts off the excess yarn segment containing the knot and continues knitting. The process method of the present invention utilizes a knot alarm set on the flat knitting machine to automatically detect knots on the yarn in advance. Once a knot is detected, the yarn segment containing the knot is pulled out and cut off, thereby removing the knot while hiding the yarn breaks and preventing yarn ladder.

6 Claims, 2 Drawing Sheets

(56) References Cited

U.S. PATENT DOCUMENTS

| | | | | | |
|---|---|---|---|---|---|
| 4,840,046 | A * | 6/1989 | Goller | ..... | D04B 15/48<br>66/127 |
| 5,544,503 | A * | 8/1996 | Miyamoto | ..... | D04B 35/16<br>66/146 |

FOREIGN PATENT DOCUMENTS

| | | | | | |
|---|---|---|---|---|---|
| CN | 107938136 | A * | 4/2018 | ..... | D04B 15/38 |
| CN | 114016204 | A | 2/2022 | | |

OTHER PUBLICATIONS

Notice of Grant issued in Chinese Patent Application No. 202111386481.0; mailed Jun. 6, 2022; 3 pgs.

* cited by examiner

FULLY AUTOMATIC METHOD FOR HANDLING YARN KNOTS IN A CONTINUOUS FLAT KNITTING PROCESS

CROSS REFERENCE TO RELATED APPLICATIONS

The present application is a Continuation of International Application Number PCT/CN2022/132731 filed Nov. 18, 2022, which claims priority to Chinese Application Number 202111386481.0 filed Nov. 22, 2021, the disclosures of which are hereby incorporated by reference herein their entireties.

BACKGROUND OF THE INVENTION

1. Technical Field

The present invention relates to the field of automated textile processing technology, particularly a method for automatically handling flat knitting knots in continuous knitting process.

2. Description of Related Art

In flat knitting process, knots often occur in yarns due to uneven thickness, yarn breakage, or yarn reel changes. In the past, knots in flat knitting process were often manually knotted and then continued with the knitting process. For certain yarns and fabric structures, small knots do not affect the smoothness and aesthetics of the fabric. However, as consumer demands for the appearance and quality of fabrics increase, knots in certain yarns or intricate knitting structures, increases the difficulty of knitting and the risk of dropped stitches, making it more prone to larger holes and higher wastage of knitted products.

Chinese Patent Application No. CN200680043124.1 discloses A method for handling the joint of a knitting yarn in which the knitting yarn is switched accurately at an arbitrary position of knitting width and the joint of a knitting yarn can be cut and removed from a fabric.

The existing technical solution mentioned above has the following defects: The knitting pattern in this method is predetermined, and the occurrence of knots is due to yarn changes, resulting in fixed positions for the knots. However, knots generated by fancy yarns, yarn breakage, or yarn reel changes have randomness and are not fixed at specific positions in the pattern. Therefore, this method is not suitable for situations where knots appear randomly.

BRIEF SUMMARY OF THE INVENTION

Technical Issues

The objective of the present invention is to provide a fully automatic method for handling flat knitting knots in continuous knitting process, aiming to solve the aforementioned problems in the prior art.

Technology Solutions

The technical purpose of The present invention is achieved through the following technical scheme:

A flat knitting continuous knitting process method for automatic processing the knots, comprising the following steps:

Step 1: The knot alarm detects the knots and emits a signal;

Step 2: A flat knitting machine automatically loads and runs a preset knot handling program;

Step 3: The flat knitting machine pulls the yarn segment containing the knot part out of the knitting area and fixes the knot part under the control of the knot handling program;

Step 4: Under the control of the knot handling program, the flat knitting machine reinserts the subsequent yarn into the knitting area, restoring it to its original knitting position before the detection signal was triggered.

Step 5: Under the control of the knot handling program, the flat knitting machine trims off the excess yarn that contain the knot portion and continues knitting until the fabric is fully formed.

The knot alarm is equipped with the capability to detect knots and emit a signal.

In a further embodiment, the knot handling program is associated with the knot alarm, and the knot handling program is automatically activated after the knot alarm is triggered.

In a further embodiment, manually adjust the detection position of the knot alarm before knitting to identify and alarm knots that can affect the appearance of the fabric.

In a further embodiment, the knot handling program is a compiled fixed process module set in the machine program.

In a further embodiment, the actions controlled by the knot handling program include: the anti-ladder action when pulling out the yarn segment containing the knot from the knitting area, securing the yarn segment after pulling it out of the knitting area, the anti-ladder action when reinserting the yarn into the knitting area, and cutting off the excess yarn segment with a clip.

In a further embodiment, The knot handling program is divided into six sub-programs based on the position of the knot occurrence: the knot alarm processing program when the carriage moves left and is positioned in the middle of the knitting area, the knot alarm processing program when the carriage moves left and is positioned at the left edge of the carriage, the knot alarm processing program when the carriage moves left and is positioned at the right edge of the carriage, the knot alarm processing program when the carriage moves right and is positioned in the middle of the knitting area, the knot alarm processing program when the carriage moves right and is positioned at the left edge of the carriage, and the knot alarm processing program when the carriage moves right and is positioned at the right edge of the carriage.

In a further embodiment, After completing the actions controlled by the knot handling program, the machine automatically switches to the previous knitting program, and then continues the subsequent knitting process following the steps before the alarm was triggered.

In a further embodiment, The anti-ladder action during both the pulling out and reinsertion involves the alternating organization of floats and tucks, while the yarn segment is secured using a clip.

In a further embodiment, After the fabric is fully knitted and removed from the machine, excess yarn is manually cut off, and there is no need for further end hiding or anti-ladder processes.

The invention has the following specific advantages:

The process method of the present invention utilizes a knot alarm set on the flat knitting machine to automatically detect knots on the yarn. Once a knot is detected, the yarn segment containing the knot can be pulled out and secured without manual intervention. This process method effectively eliminates knots randomly generated by various yarn specifications, ensuring the aesthetics of the textile products and improving production efficiency. Therefore, the present invention is suitable for widespread application in flat knitting manufacturing.

DETAILED DESCRIPTION OF THE INVENTION

Figure 1:
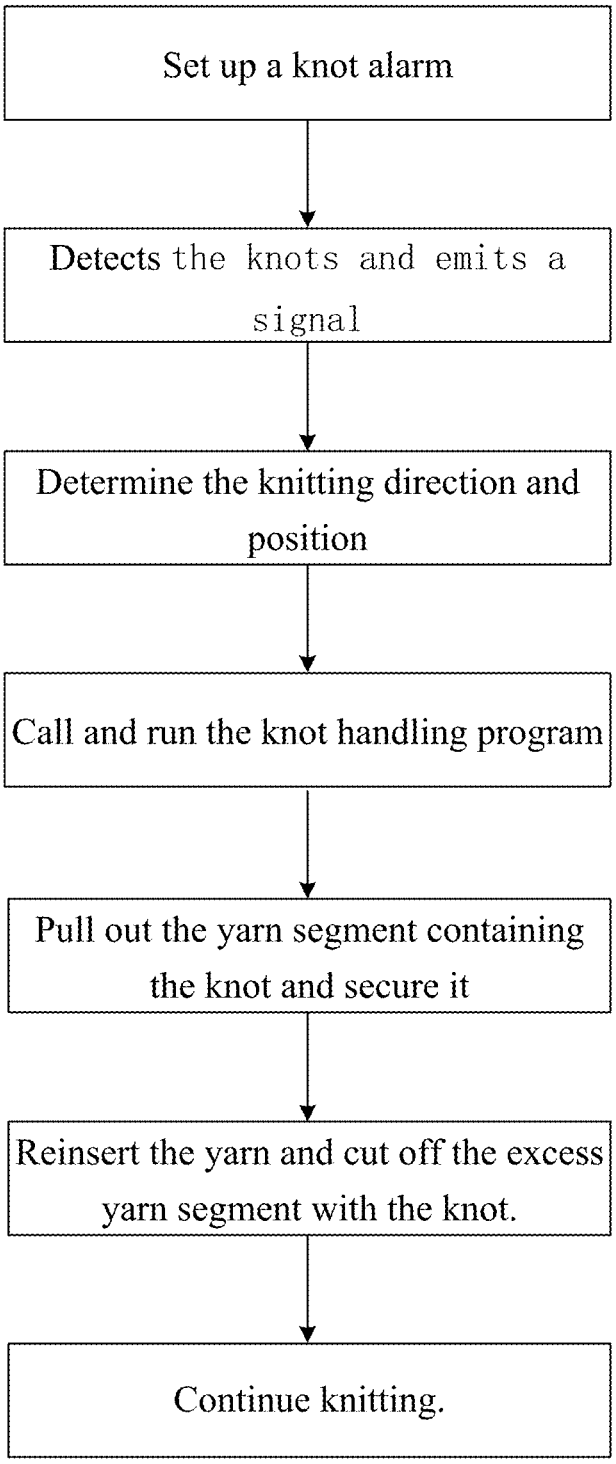
FIG. 1 is a flowchart illustrating of the process method of The present invention.

The present invention is further described in details with accompanying drawings as follows. The same parts and components are designated with the same reference numerals. It should be noted that the terms "front", "back", "left", "right", "top", and "bottom" used in the following description refer to the directions in Figures, and the terms "bottom surface" and "top surface", "inner" and "outer" respectively refer to facing towards or away from specific components geometrically. Additionally, the terms "first" and "second" are used for descriptive purposes only and should not be understood as indicating or implying relative importance or indicating the quantity of the indicated technical features. Thus, features designated as "first" and "second" may explicitly or implicitly include one or more of the features. In the description herein, the term "multiple" means two or more unless the direction of the center is specifically defined otherwise.

Embodiment 1

Figure 2:
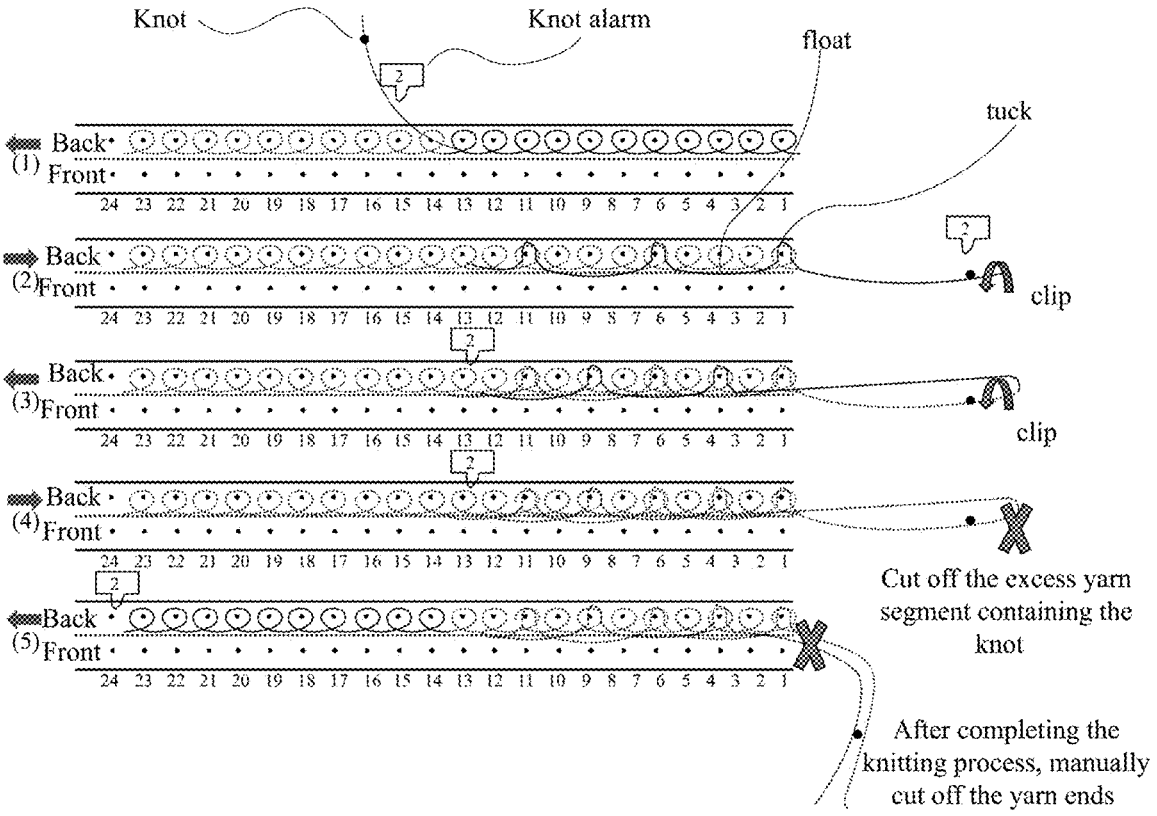
FIG. 2 is a schematic diagram illustrating the process of handling yarn with knots in The present invention.

As shown in FIG. 1 and FIG. 2, a fully automatic method for handling flat knitting knots in continuous knitting process, comprises the following steps:

1. Set a knot alarm on the flat knitting machine and manually adjust its detection position before knitting. The knot alarm detects knots on the yarn to be knitted, specifically alarming knots that may affect the appearance of the fabric. Knots are formed due to uneven yarn thickness, breakage, or yarn bobbin replacements. The existence of knots can increase knitting difficulty and impact the fabric's surface appearance. Once the knot alarm detects knots, it emits a warning.
2. The flat knitting machine automatically loads and executes a pre-set knot handling program. The knot handling program is associated with the knot alarm and is automatically activated upon the alarm being triggered. The knot handling program is a compiled and fixed process module integrated into the machine's program.

The knot handling program calls the corresponding subprogram based on the alarm position of the knot alarm and the knitting direction of the knitting machine. The number of subprograms is determined by the type of fabric being knitted. In this embodiment, the knot handling program is divided into six subprograms based on the position of the knot occurrence: the knot alarm processing program when the carriage moves left and is positioned in the middle of the knitting area, the knot alarm processing program when the carriage moves left and is positioned at the left edge of the carriage, the knot alarm processing program when the carriage moves left and is positioned at the right edge of the carriage, the knot alarm processing program when the carriage moves right and is positioned in the middle of the knitting area, the knot alarm processing program when the carriage moves right and is positioned at the left edge of the carriage, and the knot alarm processing program when the carriage moves right and is positioned at the right edge of the carriage. The six subprograms of the knot handling program control the same machine actions, but the positions of the machine actions for handling knots are different. By setting the six subprograms, the machine can quickly determine the appropriate side edge of the knitting machine to handle the yarn segment containing the knot based on the knitting progress, thereby improving the speed of knot handling.

The actions controlled by the knot handling program include: The anti-ladder action when pulling out the yarn segment containing the knot from the knitting area, securing the yarn segment after pulling it out of the knitting area, the anti-ladder action when reinserting the yarn into the knitting area, and cutting off the excess yarn segment with scissors. The anti-ladder action during both the pulling out and reinsertion is the same, achieved by alternating the float and tuck of the yarn. The yarn segment is secured by clamping using a clip set on the machine, which is activated under program control.

3. The knot handling program controls the flat knitting machine to pull the yarn segment containing the knot from the knitting area and secure the knot. When pulling out the yarn segment containing the knot from the knitting area. The anti-ladder action involves alternating the float with tuck organization. The yarn segment is secured by using an electronically controlled clip set on the machine to clamp the yarn near the knot.
4. After securing the yarn segment containing the knot, the knot handling program controls the flat knitting machine to reinsert the subsequent yarn into the knitting area. When reinserting the yarn into the knitting area, the machine performs an anti-ladder action by alternating the float with tuck organization until the yarn is reinserted back to the knitting position before the alarm was triggered.
5. The knot handling program controls the flat knitting machine to cut off the excess yarn segment containing the knot, resulting in two separate yarn ends hanging on the knitted fabric. After completing the knot handling actions, the machine automatically loads the program before knitting, Then, the process before the knot alarm continues to complete the subsequent knitting. After the knitting is completed, the excess yarn ends are manually cut off without the need for hiding the thread ends and anti-ladder processes.

Specific implementation process: To further illustrate the process of the method of the present invention, as shown in FIG. 2, taking the case where the knitting machine carriage moves left and detects knots in the middle of the knitting area as an example:

The knitting machine carriage moves left, and the knot alarm immediately triggers an alarm when it detects knots on the yarn to be used for knitting. Upon receiving the alarm, the machine automatically loads the knot handling program. The knot handling program analyzes that the carriage is moving left and the alarm position is in the middle of the knitting area. Subsequently, the subprogram of the knot handling program for the case when the carriage is moving left and in the middle of the knitting area is executed. The machine pulls the yarn to the right side, alternately it with tuck. After the yarn leaves the knitting area, a clip on the machine clamps the yarn near the knot. The machine then pulls the yarn back to the left side into the knitting area, again alternating it with tuck. Once the yarn is knitted back to the position where the alarm was triggered, the machine cuts the yarn containing the knot with scissors, resulting in two yarn ends. After completing the knitting process, the two exposed yarn ends are manually cut off.

In the embodiments disclosed in this invention, terms such as "installation," "connection," "linking," and "fixing" should be interpreted in a broad sense. For example, "connection" can refer to a fixed connection, a detachable connection, or an integral connection. "Linking" can be a direct connection or an indirect connection through an intermediary. Those skilled in the art can understand the specific meanings of these terms in the disclosed embodiments of this invention based on the specific circumstances.

The specific embodiment described above is only an explanation of the present invention, and it is not intended to limit The present invention. Those skilled in the art can make modifications to the present embodiment without creative contribution as needed after reading this specification, but such modifications are protected by the patent law as long as they fall within the scope of the claims of the present invention.

What is claimed is:

1. A continuous flat knitting method for automatic processing of knots, comprising the following steps:

Step 1: setting a knot alarm on a flat knitting machine, the knot alarm detecting a knot in a yarn segment of a knitted yarn, wherein the yarn segment comprises a knot part and the knot part comprises the knot, and the knot alarm emitting a signal;

Step 2: the flat knitting machine automatically loading and running a preset knot handling program;

Step 3: the flat knitting machine pulling the yarn segment out of a knitting area and fixing the knot part under control of the knot handling program;

Step 4: under the control of the knot handling program, the flat knitting machine inserting a subsequent yarn section of the same knitted yarn that has been pulled out of the knitting area into the knitting area, until the subsequent yarn section is inserted to a knitting position before the alarm was triggered;

Step 5: under the control of the knot part handling program, the flat knitting machine trimming off an excess yarn portion that contains the knot part and continuing knitting until a fabric is fully formed, wherein the excess yarn portion is an excess yarn portion of the yarn segment that has been pulled out of the knitting area;

wherein actions controlled by the knot handling program also include a first anti-ladder action when pulling out the yarn segment from the knitting area and a second anti-ladder action when inserting the yarn into the knitting area, wherein when pulling out the yarn segment from the knitting area, the first anti-ladder action involves alternating floats with tucks, the yarn segment is secured by using an electronically controlled clip set on the flat knitting machine to clamp the yarn near the knot part;

when inserting the yarn into the knitting area, the flat knitting machine performing the second anti-ladder action by alternating floats with tucks until the yarn is inserted back to the knitting position before the alarm was triggered.

2. The continuous flat knitting method for automatic processing of knots according to claim 1, characterized in that: the knot handling program is associated with the knot alarm, and the knot handling program is automatically activated when the knot alarm is triggered.

3. The continuous flat knitting method for automatic processing of knots according to claim 1, characterized in that: manually adjust a detection position of the knot alarm before knitting to identify and alarm knots that can affect an appearance of the fabric.

4. The continuous flat knitting method for automatic processing of knots according to claim 1, characterized in that: the knot handling program is a compiled fixed process module set in the flat knitting machine program, wherein the flat knitting machine program is a control program of the flat knitting machine.

5. The continuous flat knitting method for automatic processing of knots according to claim 1, characterized in that: after completing the actions controlled by the knot handling program, the machine automatically switches to a knitting program of the fabric, and then continues a subsequent knitting process before the knot alarm was triggered.

6. The continuous flat knitting method for automatic processing of knots according to claim 1, characterized in that: after the fabric is fully knitted and removed from the machine, a different excess yarn portion at a knitting end is manually cut off, and there is no need for further end hiding or anti-ladder processes.

* * * * *